United States Patent [19]

Shaub

[11] Patent Number: 4,617,134

[45] Date of Patent: Oct. 14, 1986

[54] METHOD AND LUBRICANT COMPOSITION FOR PROVIDING IMPROVED FRICTION REDUCTION

[75] Inventor: Harold Shaub, New Providence, N.J.

[73] Assignee: Exxon Research and Engineering Company, Florham Park, N.J.

[21] Appl. No.: 376,934

[22] Filed: May 10, 1982

Related U.S. Application Data

[63] Continuation-in-part of Ser. No. 205,314, Nov. 10, 1980, abandoned.

[51] Int. Cl.[4] ..... C10M 105/08; C10M 105/22

[52] U.S. Cl. ..... 252/32.7 E

[58] Field of Search ..... 252/32.7 E

[56] References Cited

U.S. PATENT DOCUMENTS

| | | | |
|---|---|---|---|
| 3,180,832 | 4/1965 | Furey | 252/56 |
| 3,381,022 | 4/1968 | LeSuer | 260/404.8 |
| 3,429,817 | 2/1969 | Furey et al. | 252/56 |
| 3,522,179 | 7/1970 | LeSuer | 252/51.5 |
| 3,542,678 | 11/1970 | Bork | 252/51.5 |
| 3,542,680 | 11/1970 | LeSuer | 252/57 |
| 3,632,511 | 1/1972 | Liao | 252/51.5 A |
| 3,796,662 | 3/1979 | Lyle et al. | 252/32.7 E |
| 3,804,763 | 4/1974 | Meinhardt | 252/51.5 A |
| 3,899,432 | 8/1975 | Rothert et al. | 252/32.7 E |
| 3,920,562 | 11/1975 | Fuehr | 252/32.7 E |
| 3,933,659 | 9/1976 | Lyle et al. | 252/32.7 E |
| 3,991,056 | 11/1976 | Okamoto et al. | 252/32.7 E |
| 4,010,106 | 3/1977 | Rothert | 252/32.7 E |
| 4,105,571 | 8/1978 | Shaub et al. | 252/32.7 E |

*Primary Examiner*—William R. Dixon, Jr.
*Assistant Examiner*—Margaret B. Medley
*Attorney, Agent, or Firm*—Eugene Zagarella; Edward H. Mazer

[57] ABSTRACT

A method and composition for obtaining improved friction reducing properties is provided by a lubricating oil composition and the lubrication of internal combustion engines with said composition which comprises an additive combination of an ester of a polycarboxylic acid with a glycol or glycerol and an ashless dispersant containing a high molecular weight aliphatic hydrocarbon oil solubilizing group attached thereto and a selected amount of free hydroxyl groups.

8 Claims, No Drawings

METHOD AND LUBRICANT COMPOSITION FOR PROVIDING IMPROVED FRICTION REDUCTION

CROSS-REFERENCE TO RELATED APPLICATIONS

This application is a continuation-in-part of Ser. No. 205,314, filed Nov. 10, 1980, now abandoned.

BACKGROUND OF THE INVENTION

This invention relates to a method and lubricating oil composition for providing improved friction reducing properties.

There has been considerable effort in recent years to develop lubricating oil compositions which will reduce friction in engines and particularly automotive engines. This effort is based on the need to improve the fuel economy of such engines which operate on petroleum fuel, a product having a declining source of supply and an escalating price. It is known that high engine friction causes significant energy loss and thus one way to improve fuel economy is to reduce such friction.

Known ways to solve the problem of energy losses due to high friction e.g., in crankcase motor oils include the use of synthetic ester base oils which are expensive and the use of insoluble molybdenum sulfides which have the disadvantage of giving the oil composition a black or hazy appearance.

Another approach to reduce energy losses by the use of a lubricating oil composition involves a composition containing an additive combination of an oil soluble friction reducing ester component derived from esterification of a polycarboxylic acid with a glycol and a zinc dihydrocarbyl dithiophosphate. This type of composition is disclosed in U.S. Pat. No. 4,105,571 which notes that while a lubricating composition containing the additive package of such ester and zinc thiophosphate components provides excellent anti-friction and anti-wear properties, it presents compatability and stability problems. The problem is solved by adding a selected ashless dispersant containing a high molecular weight aliphatic hydrocarbon oil solubilizing group attached thereto to the composition, and preferably predispersing either the ester and/or zinc thiophosphate components prior to their addition to the remainder of the composition. Such ashless dispersants may contain hydroxyl groups as noted in the patent.

While the above approaches all provide reduced engine friction and consequently improved fuel economy, there is always the need and desire for further reductions in energy losses due to friction or otherwise since even small reductions per engine can result in a rather large savings in fuel, particularly when considering the total number of engines in use.

SUMMARY OF THE INVENTION

It has now surprisingly been discovered that lubricating oil compositions containing an additive combination of an ester of a polycarboxylic acid and a glycol or glycerol plus zinc dihydrocarbyl dithiophosphate can be made storage stable and have particularly improved friction reducing properties when an ashless dispersant containing a selected amount of free hydroxyl is used. More particularly a storage stable lubricating oil composition with improved friction reducing properties is provided by the composition of this invention which includes an additive combination of (1) an ester of a polycarboxylic acid with a glycol or glycerol, (2) a zinc dihydrocarbyl dithiophosphate and (3) an ashless dispersant containing a high molecular weight aliphatic hydrocarbon oil solubilizing group attached thereto and a selected amount of free hydroxyl groups.

In accordance with the present invention a storage stable lubricating oil composition with improved friction reducing properties is provided by a composition comprising a major portion of lubricating oil, from about 0.01 to 1.0 parts by weight of an ester of a polycarboxylic acid with a glycol or glycerol, from about 0.01 to about 5.0 parts by weight of zinc dihydrocarbyl dithiophosphate and from about 0.1 to about 20 parts by weight of an hydroxyl containing ashless dispersant having a high molecular weight aliphatic hydrocarbon oil solubilizing group attached thereto, said dispersant containing from about 0.35 to about 1.8 millimoles (mM) of free hydroxyl per gram of dispersant, all weights based on 100 parts by weight of said lubricating oil composition.

Another embodiment of this invention relates to a method of reducing friction in an internal combustion engine by lubricating said engine using a lubricating oil composition containing an effective friction reducing amount of an additive which is an ester of a polycarboxylic acid with a glycol or glycerol and from about 0.1 to about 20 parts by weight, based on the weight of lubricating oil composition, of an hydroxyl containing ashless dispersant having a high molecular weight aliphatic hydrocarbon oil solubilizing group attached thereto, said dispersant containing from about 0.35 to about 1.8 millimoles (mM) of free hydroxyl groups per gram of dispersant.

DETAILED DESCRIPTION OF THE INVENTION

As previously indicated the present invention relates to a storage stable lubricating oil composition having particularly improved friction reducing properties comprising an additive combination of an ester of a polycarboxylic acid and a glycol or glycerol, zinc dihydrocarbyl dithiophosphate and an ashless dispersant containing a selected amount of free hydroxyl groups. This invention further involves a method of reducing friction in an internal combustion engine by lubricating said engine with the aforesaid lubricating oil which contains the combination of polycarboxylic acid ester and selected ashless dispersant.

The oil soluble friction reducing ester component used in the composition of this invention generally, can be any hydroxy substituted oil soluble ester of a polycarboxylic acid.

Best results are, however, obtained when such compounds are derived from the esterification of a polycarboxylic acid with a glycol or glycerol, preferably glycol. Such an ester may be a partial, di- or polyester with typical formulas of the ester represented by the following general formulas when using a glycol:

(1) HO—R—OOC—R″—COOH (2) HO—R—OOC—R″—COOR′—OH (3) HO—R—OOC—R″—COOR—OOC—R′′—COOR′—OH wherein R″ is the hydrocarbon radical of said acid and each R and R′ may be the same or different hydrocarbon radicals associated with a glycol or diol as hereinafter defined. It will, of course, be appreciated that esters of the type illustrated by the foregoing formulas can be obtained by esterifying a polycarboxylic acid, or a mixture of such acids, with a diol or mixture of such diols.

The polycarboxylic acid used in preparing the ester may be an aliphatic saturated or unsaturated acid and will generally have a total of about 24 to about 90, preferably about 24 to about 60 carbon atoms and about 2 to about 4, preferably about 2 to about 3 and more preferably about 2 carboxylic acid groups with at least about 9 up to about 42 carbon atoms, preferably about 12 to about 42 and more preferably about 16 to about 22 carbon atoms between the carboxylic acid groups.

The oil insoluble glycol which is reacted with the polycarboxylic acid may be an alkane diol, i.e. alkylene glycol or an oxa-alkane diol, i.e. polyalkylene glycol, straight chain or branched. The alkane diol may have from about 2 to about 12 carbon atoms and preferably about 2 to about 5 carbon atoms in the molecule and the oxa-alkane diol will, generally, have from about 4 to about 200, preferably about 4 to about 100 carbon atoms. The oxa-alkane diol (polyalkylene glycol) will, of course, contain periodically repeating groups of the formula:

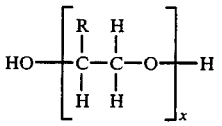

wherein R may be H, $CH_3$, $C_2H_5$ or $C_3H_7$, and x is 2 to 100, preferably 2 to 25. The preferred alkane diol or alkylene glycol is ethylene glycol and the preferred oxa-alkane diol or polyalkylene glycol is diethylene glycol. As indicated previously, glycerol may also be used in preparing the ester of polycarboxylic acid and it is contemplated that such component will also include its higher molecular weight analogues.

While any of the esters as set forth above can be effectively used, best results are, however, obtained with such compounds wherein the carboxyl groups of the polycarboxylic acid are separated from each other by from about 16 to about 22 carbon atoms and wherein the hydroxy groups are separated from the closest carboxyl group by from about 2 to about 12 carbon atoms. Particularly desirable results have been obtained with additives prepared by esterifying a dimer of a fatty acid particularly those containing conjugated unsaturation with a polyhydroxy compound. Such dimers are, of course, clearly taught in U.S. Pat. No. 3,180,832 which was granted on Apr. 27, 1965 and U.S. Pat. No. 3,429,817 which was granted on Feb. 25, 1969, and as there indicated, the hydrocarbon portion of the dimer or dicarboxylic acid thus obtained may contain a six member ring. The formation of the dimer from linoleic acid, oleic acid and mixtures of these acids is illustrated by the following:

A.

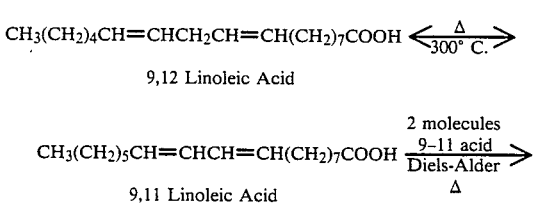

-continued

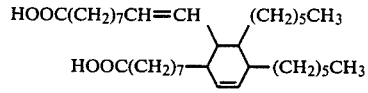

Linoleic Acid Dimer (dilinoleic acid)

B.

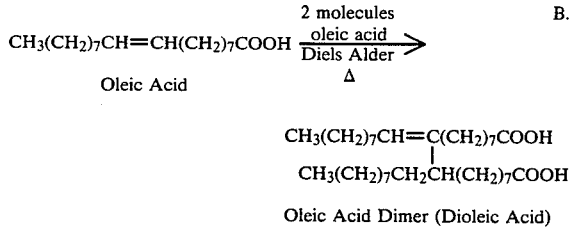

Oleic Acid Dimer (Dioleic Acid)

C.

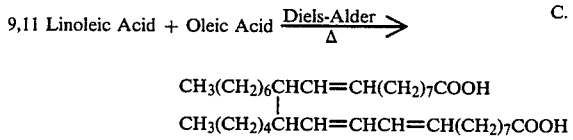

Mixed Dimer

It will, of course, be appreciated that while the reactions illustrated produce the dimers, commercial application of the reactions will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention.

The preferred hydroxy-substituted ester lubricity additives useful in the present invention will be the reaction product of a dimerized fatty acid, such as those illustrated, and an oil insoluble glycol and may be produced by various techniques. As previously pointed out, the preferred acid dimers are the dimers of linoleic acid, oleic acid or the mixed dimer of linoleic and oleic acids, which may also contain some monomer as well as trimer. Other specifically satisfactory glycols in addition to ethylene glycol and polyethylene glycol are, for example, propylene glycol, polypropylene glycol, butylene glycol, polybutylene glycol and the like.

The zinc dihydrocarbyl dithiophosphates useful in the present invention are salts of dihydrocarbyl esters of dithiophosphoric acids and may be represented by the following formula:

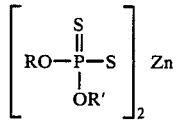

wherein R and R′ may be the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec-butyl, tert-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms in the dithiophosphoric acid will average about 5 or greater.

The zinc dihydrocarbyl dithiophosphates which are useful in the compositions of the present invention may be prepared in accordance with known techniques by first esterifying a dithiophosphoric acid usually by reaction of an alcohol or phenol with $P_2S_5$ and then neutralizing the dithiophosphoric acid ester with a suitable zinc compound such as zinc oxide. In general, the alcohol or mixtures of alcohols containing from 1 to 18 carbon atoms may be used to effect the esterification. The hydrocarbon portion of the alcohol may, for example, be a straight or branched chain alkyl or alkenyl group, or a cycloaliphatic or aromatic group. Among the alcohols which are generally preferred for use as starting materials in the preparation of the esters may be mentioned ethyl, isopropyl, amyl, 2-ethylhexyl, lauryl, stearyl and methyl cyclohexyl alcohols as well as commercial mixtures of alcohols, such as the mixture of alcohols derived from coconut oil and known as "Lorol B" alcohol, which mixture consists essentially of alcohols in the $C_{10}$ to $C_{18}$ range. Other natural products containing alcohols such as the alcohols derived from wool fat, natural waxes and the like may be used. Moreover, alcohols produced by the oxidation of petroleum hydrocarbon products as well as the Oxoalcohols produced from olefins, carbon monoxide and hydrogen may be employed. Further aromatic compounds such as alkylated phenols of the type n-butyl phenol, tertiaryamyl phenol, diamyl phenol, tertiary octyl phenol, cetyl phenol, petroleum phenol and the like as well as the corresponding naphthols may be employed in like manner.

Following the esterification, the diester is then neutralized with a suitable basic zinc compound or a mixture of such compounds. In general, any compound could be used but the oxides, hydroxides and carbonates are most generally employed.

Generally, any lubricating oil ashless dispersant containing a high molecular weight aliphatic hydrocarbon oil solubilizing group attached thereto and the selected amount of free hydroxyl groups can be used in the composition of this invention. More particularly, said dispersant will contain from about 0.35 to about 1.8 millimoles of free hydroxyl per gram of dispersant, preferably from about 0.5 to about 1.5 and more preferably about 0.7 to about 1.3 millimoles of free hydroxyl per gram of dispersant. In referring to dispersant in the context of free hydroxyl groups, the gram weight is of active dispersant, i.e. it does not include the carrier or lubricating oil in which the dispersant is diluted or otherwise dispersed.

The significance of the hydroxyl content in the dispersant is the essential feature of this invention since it has surprisingly been found that controlling hydroxyl content per gram of active dispersant results in significantly lower engine friction. Additionally, there is a minimum amount of hydroxyl content which must be maintained in the dispersant in order to retain composition stability. Accordingly, it is essential that the dispersant contain a selected amount of free hydroxyl content as described herein to provide a lubricating composition with improved friction reducing properties while retaining its stability.

A variety of compounds may be used as the ashless dispersant in the composition of this invention provided they have a suitable high molecular weight aliphatic hydrocarbon oil solubilizing group attached thereto and most important a selected amount of free hydroxyl groups. Dispersant compounds of this type include esters of mono and polycarboxylic acids with polyhydric alcohols, phenols and naphthols as well as nitrogen containing compounds containing the necessary hydroxyl content as previously noted. It is contemplated that mixtures and a wide variety of compounds may be utilized as the ashless dispersant or ashless dispersant system in this invention provided the necessary functionality is available, particularly the selected amount of free hydroxyl content. Thus, the ashless dispersant of this invention may comprise a mixture of a hydroxylated and non-hydroxylated compound provided the necessary functionality as defined herein is satisfied. Accordingly, the term ashless dispersant as used throughout this application is intended to include such mixtures and combination of compounds thereof.

The different dispersants which can be used in this invention are characterized by a long chain hydrocarbon group or groups, which may be attached, e.g. to the acid, so the acid contains a total of about 50 to about 400 carbon atoms, said acid being attached, e.g. to an amine and/or ester group or both.

Ester containing ashless dispersants of this invention can be derived from polyhydric aliphatic alcohols or polyhydric aromatic hydroxyl containing compounds such as phenols and naphthols. The polyhydric alcohols and aromatic compounds used will preferably contain from 2 to about 10 hydroxy radicals and are illustrated by ethylene glycol, diethylene glycol, triethylene glycol, tetraethylene glycol, dipropylene glycol, tripropylene glycol, dibutylene glycol, tributylene glycol, and other alkylene glycols in which the alkylene radicals contain from about 2 to about 8 carbon atoms. Also, resorcinol, catechol, p,p'-dihydroxybiphenyl, 4,4'-methylene bis-phenol, di (hydroxyphenyl) oxide, and di (hydroxyphenyl) sulfide. Other useful polyhydric compounds include glycerol, mono-oleate of glycerol, pentaerythritol, trimethylol propane, 9,10-dihydroxystearic acid, 1,2-butanediol, 2,3-hexanediol, 2,4 hexanediol, pinacol, erythritol, arabitol, sorbitol, mannitol, and 1,2-cyclohexanediol. Carbohydrates such as sugars, starches, cellulose, etc., likewise may yield appropriate esters as exemplified by glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms such as octanoic acid, oleic acid, stearic acid, linoleic acid, dodecanoic acid or tall oil acid. Examples of such partially esterified polyhydric alcohols are the monooleate of glycerol, monosterate of glycerol, di-dodecanote of erythritol.

The ester dispersant of this invention may also be derived from unsaturated alcohols, ether-alcohols, and amino alcohols including for example: oxy-alkylene, oxy-arylene, amino-alkylene, and amino-arylene substituted alcohols. Such compounds include di (hydroxyethyl) amine, tri (hydroxypropyl) amine, N,N,N,N-tetrahydroxytrimethylenediamine, 2-amino-2-methyl-1,3 propanediol, 2-amino-2-ethyl-1,3-propanediol, tris (hydroxymethyl) amino-methane, etc.

As indicated earlier, the particular dispersants used in this invention contain a long chain hydrocarbon group which will generally have about 50 to about 400 carbon atoms and preferably will be derived from an alkenyl succinic acid/anhydride where the alkenyl radical will have a molecular weight of at least about 900 and preferably at least about 1200 and more preferably at least about 1300.

A large number of dispersants having the above identified characteristics can be used in this invention some of which are disclosed in U.S. Pat. Nos. 4,105,571; 3,542,678; 3,522,179; 3,542,680; 3,632,511; and 3,804,763. Methods for preparing such dispersants are generally well known and are also disclosed in the noted patents. Some particularly preferred dispersant combinations include (1) a combination of a polyisobutenyl succinic anhydride, a hydroxy compound e.g. pentaerythritol and a polyoxyalkylene polyamine e.g. polyoxypropylenediamine and a polyalkylene polyamine e.g. polyethylenediamine and tetraethylene pentamine and (2) a combination of polyisobutenyl succinic anhydride, polyalkylene polyamine e.g. tetraethylene pentamine and a polyhydric alcohol or polyhydroxy-substituted aliphatic primary amine e.g. pentaerythritol or trismethylolaminomethane.

In general, the zinc dihydrocarbyl dithiophosphate will be used in the lubricating composition at a concentration within the range of about 0.01 to about 5 parts by weight per 100 parts of lubricating oil composition and preferably from about 0.5 to about 1.5. The polycarboxylic acid/glycol or glycerol ester will be used at a concentration of about 0.01 to about 2.0, preferably about 0.05 to about 1.0 and more preferably 0.05 to 0.5 parts by weight per 100 parts of lubricating oil composition and the ashless dispersant will be employed at a concentration of about 0.1 to about 20 and preferably about 0.5 to about 10 parts by weight per 100 parts of lubricating oil composition.

The lubricating oil liquid hydrocarbons which may be used include the mineral lubricating oils and the synthetic lubricating oils and mixtures thereof. The synthetic oils will include diester oils such as di (2-ethylhexyl) sebacate, azelate and adipate; complex ester oils such as those formed from dicarboxylic acids, glycols and either monobasic acids or monohydric alcohols; silicone oils; sulfide esters; organic carbonates; and other synthetic oils known to the art.

Other additives, of course, may be added to the oil compositions of the present invention to form a finished oil. Such additives may be the conventionally used additives including oxidation inhibitors such as phenothiazine or phenyl $\alpha$-naphthylamine; rust inhibitors such as lecithin or sorbitan monoleate; detergents such as barium phenates; pour point depressants such as copolymers of vinyl acetate with fumaric acid esters of coconut oil alcohols; viscosity index improvers such as olefin copolymers, polymethacrylates; etc. A particularly useful additive is the basic alkaline earth metal salts of an organic sulfonic acid, generally a petroleum sulfonic acid or a synthetically prepared alkaryl sulfonic acid. Among the petroleum sulfonates, the most useful products are those prepared by the sulfonation of suitable petroleum fractions with subsequent removal of acid sludge and purification. Synthetic alkaryl sulfonic acids are usually prepared from alkylated benzenes such as the Friedel-Crafts reaction product of benzene and a polymer such as tetrapropylene. Suitable acids may also be obtained by sulfonation of alkylated derivatives of such compounds as diphenylene oxide thianthrene, phenolthioxine, diphenylene sulfide, phenothiazine, diphenyl oxide, diphenyl sulfide, diphenylamine, cyclohexane, decahydro naphthalene and the like.

Basic alkaline earth metal sulfonates are generally prepared by reacting an alkaline earth metal base, e.g. lime, magnesium oxide, magnesium alcoholate with $CO_2$ in the presence of sulfonic acid or neutral metal sulfonates, ordinarily the calcium, magnesium or barium salts. These neutral salts in turn may be prepared from the free acids by reaction with the suitable alkaline earth metal base, or by double decomposition of an alkali metal sulfonate, which methods are well known in the art. Further details are described in U.S. Pat. No. 3,562,159.

The composition of this invention is particularly useful when metal containing additives such as the normal and basic metal phenates, sulfonates or sulfurized phenates are used since such components have been known to cause compatability problems in more conventional type lubricant compositions.

The above described additive package may be used in conventional base oils with other conventional additives. While the components can generally be added in their normal and conventional manner, it is a preferred embodiment of this invention to keep the zinc dihydrocarbyl dithiophosphate and polycarboxylic acid/glycol or glycerol ester components apart from one another until at least one of such components has been predispersed as described in U.S. Pat. No. 4,105,571. This will help to maintain a storage stable and compatible composition. By predispersed it is meant that the ester component or the zinc component or both separately are mixed with the ashless dispersant, which may be in oil solution, until the solution is generally clear.

The following examples are further illustrative of this invention and are not intended to be construed as limitations thereof.

EXAMPLE 1

Formulations were prepared using a 10W-40SE quality automotive engine oil containing 1.5% by weight, based on the total lubricating oil weight, of zinc dialkyl dithiophosphate (80% active ingredient in diluent mineral oil) in which the alkyl groups were a mixture of such groups having between 4 and 5 carbon atoms and made by reacting $P_2S_5$ with a mixture of about 65% isobutyl alcohol and 35% of amyl alcohol; 0.1% by weight, based on the total lubricating oil weight of an ester formed by esterification of a dimer acid of linoleic acid and diethylene glycol and having the formula:

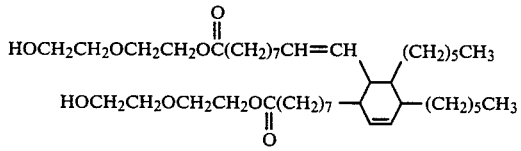

This additive is actually a mixture of the structure shown plus higher molecular weight repeating units (polymers) of this material.

Dispersants containing different amounts of free hydroxyl contents were used on the different lubricating formulations as described below:

(A) 5.25% by wt. of dispersant (mixture of 46.5% by weight active ingredient in mineral lubricating oil) was used, said dispersant prepared by reacting polyisobutenyl succinic anhydride (PIBSA), the polyisobutenyl radical (PIB) having an average molecular weight ($\overline{Mn}$) of about 900 with an equal molar amount of pentaerythritol and a minor amount of a polyamine mixture comprising polyoxypropylene amine and polyethylene amines to form a a product having a nitrogen content of about 0.35% by weight and having a millimole (mM) hydroxyl per gram of active ingredient of 2.00. Materials of this type are described in U.S. Pat. No. 3,804,763 and sold by Lubrizol Corporation under the tradename Lubrizol 6401;

(B) A dispersant similar to A described above but having about 75% of the pentaerythritol added was prepared and had a nitrogen content of 0.27% and 1.55 mM of hydroxyl per gram of active ingredient;

(C) Another dispersant similar to A described above but using about 50% of the pentaerythritol was prepared and had a nitrogen content of 0.44% and 1.25 mM of hydroxyl per gram of active ingredient;

(D) Another dispersant similar to A described above was prepared using 10% of pentaerythritol and had a nitrogen content of 1.05% and 0.75 mM of hydroxyl per gram of active ingredient.

The dispersants noted above were added to the 10W-40SE crankcase oil along with the other additives and a rust inhibitor, i.e. overbased magnesium sulfonate, a detergent and a VI improver, i.e. an ethylene-propylene copolymer.

The above noted compositions all exhibited storage stability and compatibility over an extended period and were further tested for relative friction using a ball on cylinder test.

The apparatus used in the ball on cylinder test is described in the Journal of the American Society of Lubrication Engineers, entitled "ASLE Transactions", Vol. 4 pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, a constant rpm and a fixed time and in each of the tests of this example, a 4 Kg load, 0.26 rpm and 70 minutes was used. The actual friction was determined from the power actually required to effect rotation and the relative friction determined by ratioing the actual load to that of a standard. The apparatus and method used is more fully described in U.S. Pat. No. 3,129,580 which was issued May 21, 1964 to Furey et al and which is entitled "Apparatus for Measuring Friction and Contacts Between Sliding Lubricating Surfaces".

The results of ball on cylinder test are given below:

| Composition | mM OH per gram of Active Dispersant | Coeff of Frict. @ 70 Min. |
|---|---|---|
| A | 2.0 | .135 |
| B | 1.55 | .095 |
| C | 1.25 | .075 |

-continued

| Composition | mM OH per gram of Active Dispersant | Coeff of Frict. @ 70 Min. |
|---|---|---|
| D | 0.75 | .055 |

While noting in the above composition that the amount of friction was significantly reduced by decreasing the hydroxyl content, it was ascertained that a level of about 0.35 mM OH/gram of active dispersant was needed to have a compatible system. Thus, the surprising friction effects of using the composition of this invention wherein a dispersant having selected hydroxyl content is used is readily shown by the results.

What is claimed is:

1. In a method of reducing friction in an internal combustion engine comprising lubricating said engine using a lubricating oil composition containing an effective friction reducing amount of an additive which is an ester of a polycarboxylic acid with a glycol or glycerol and from about 0.1 to about 20 parts by weight, based on the weight of lubricating oil composition of an hydroxyl containing ashless dispersant having a high molecular weight aliphatic hydrocarbon oil solubilizing group attached thereto, the improvement comprising said dispersant containing from about 0.35 to about 1.8 millimoles of free hydroxyl groups per gram of dispersant.

2. The method of claim 1 wherein said dispersant is derived from an alkenyl succinic acid or anhydride with said alkenyl group having a molecular weight of at least about 900.

3. The method of claim 2 wherein said dispersant contains from about 0.5 to about 1.5 millimoles of free hydroxyl groups per gram of dispersant.

4. The method of claim 3 wherein said dispersant is an ester containing derivative of alkenyl succinic acid or anhydride derived from polyhydric alcohols, phenols and naphthols.

5. The method of claim 4 wherein from about 0.01 to about 2.0 parts by weight of said polycarboxylic acid ester is used and said composition also contains from about 0.01 to about 5.0 parts by weight of zinc dihydrocarbyl dithiophosphate, said weights based on 100 parts by weight of lubricating oil composition.

6. The method of claim 5 wherein said polycarboxylic acid is formed from a dicarboxylic acid having from about 9 to about 42 carbon atoms between carboxylic acid groups and a glycol which is selected from the group consisting of alkane diols having from about 2 to about 12 carbon atoms or an oxa-alkane diol having from about 4 to about 200 carbon atoms.

7. The method of claim 6 wherein said polycarboxylic acid ester is formed from a dimer acid of a conjugated fatty acid having from about 16 to about 22 carbon atoms between carboxylic acid groups.

8. The method of claim 7 wherein said dispersant contains from about 0.7 to bout 1.3 millimoles of free hydroxyl gruops per gram of dispersant.

* * * * *